US010477915B2

(12) United States Patent
Hughes et al.

(10) Patent No.: US 10,477,915 B2
(45) **Date of Patent: *Nov. 19, 2019**

(54) DEVICE FOR HIGH-HEELED SHOES AND METHOD OF CONSTRUCTING A HIGH-HEELED SHOE

(71) Applicant: HBN SHOE, LLC, Salem, NH (US)

(72) Inventors: Brian G. R. Hughes, San Antonio, TX (US); Howard Dananberg, Stowe, VT (US)

(73) Assignee: HBN SHOE, LLC, Salem, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/819,951

(22) Filed: Nov. 21, 2017

(65) Prior Publication Data

US 2018/0092429 A1 Apr. 5, 2018

Related U.S. Application Data

(63) Continuation-in-part of application No. 15/057,925, filed on Mar. 1, 2016.

(51) Int. Cl.

| | |
|---|---|
| ***A43B 7/14*** | (2006.01) |
| ***A43B 17/02*** | (2006.01) |
| ***A43B 17/14*** | (2006.01) |

(52) U.S. Cl.

CPC ..... *A43B 7/141* (2013.01); *A43B 7/144* (2013.01); *A43B 7/148* (2013.01); *A43B 7/1425* (2013.01);

(Continued)

(58) Field of Classification Search

CPC ..... A43B 7/141; A43B 17/00; A43B 7/144; A43B 7/1425

(Continued)

(56) References Cited

U.S. PATENT DOCUMENTS

| | | | |
|---|---|---|---|
| 73,924 | A | 1/1868 | Pickett |
| 975,576 | A | 11/1910 | Sexton |

(Continued)

FOREIGN PATENT DOCUMENTS

| | | | |
|---|---|---|---|
| CN | 1233943 | 11/1999 | ..... A43B 13/40 |
| CN | 2688103 | 3/2005 | ..... A43B 17/08 |

(Continued)

OTHER PUBLICATIONS

"New Styling for High-Heeled Comfort: The Classic Pump Redefined for Fashion Wear" Dananberg, Current Podiatric Medicine, 1990, pp. 29-32.

(Continued)

*Primary Examiner* — Alissa J Tompkins
*Assistant Examiner* — Catherine M Ferreira
(74) *Attorney, Agent, or Firm* — Hayes Soloway P.C.

(57) ABSTRACT

Provided is a device for insertion into a heeled shoe, having a rear region positioned to underlying a wearer's calcaneal tuberosity, the rear region being shaped to accommodate a planer surface of the wearer's calcaneal tuberosity, an upper surface of said rear region having a raised portion underlying an area of the wearer's calcaneus immediately forward of the wearer's calcaneus tuberosity; and a forward region positioned to underlie at least a portion of the shafts of the wearer's metatarsals, the second upper surface of said forward region having a raised portion which gradually rises to an apex position to underlie the shafts of the wearer's second and third metatarsals.

20 Claims, 5 Drawing Sheets

(52) U.S. Cl.
CPC ..... *A43B 7/1445* (2013.01); *A43B 17/02* (2013.01); *A43B 17/14* (2013.01)

(58) Field of Classification Search
USPC ..... 36/174
See application file for complete search history.

(56) References Cited

U.S. PATENT DOCUMENTS

| | | | | |
|---|---|---|---|---|
| 1,055,768 | A | 3/1913 | Levee et al. | |
| 1,137,092 | A | 4/1915 | Sharp | |
| 1,210,066 | A | 12/1916 | Hara | |
| 1,287,810 | A | 12/1918 | Wojteck | |
| 1,387,952 | A | 8/1921 | Steinbrecher | |
| 1,550,715 | A | 6/1923 | Stout | |
| 1,480,234 | A | 1/1924 | Wedd | |
| 1,503,764 | A | 8/1924 | Nickerson | |
| 1,544,625 | A | 7/1925 | Austin | |
| 1,557,312 | A | 10/1925 | Lelyveld | |
| 1,728,243 | A | 9/1929 | Marshalek | |
| 1,760,300 | A | 5/1930 | Donovan | 36/43 |
| 1,777,855 | A | 10/1930 | Oblak | 36/43 |
| 1,819,539 | A | 8/1931 | Bringardner | |
| RE18,237 | E | 10/1931 | Messler | |
| 1,827,044 | A | 10/1931 | Simon | |
| 1,828,086 | A | 10/1931 | Tweedie | |
| 1,847,287 | A | 3/1932 | White | |
| 1,847,973 | A | 3/1932 | Morton | |
| 1,864,999 | A | 6/1932 | Gluckman | |
| 1,907,997 | A | 5/1933 | Nickerson | |
| 1,957,695 | A | 5/1934 | Chiapetta | 36/71 |
| 1,960,418 | A | 5/1934 | Schaller | 36/71 |
| 1,992,081 | A | 2/1935 | Madinger | 36/71 |
| 2,008,207 | A | 7/1935 | Greenberg | 36/71 |
| 2,029,409 | A | 2/1936 | Brand | 36/71 |
| 2,034,463 | A | 3/1936 | Dvlinsky | 36/71 |
| 2,046,732 | A | 7/1936 | Fein | 36/43 |
| 2,055,072 | A | 9/1936 | Everston | 36/28 |
| 2,081,474 | A | 5/1937 | Burns | 36/71 |
| 2,088,263 | A | 7/1937 | Grouven | 36/8.5 |
| 2,092,910 | A | 9/1937 | Daniels | 36/71 |
| 2,097,759 | A | 11/1937 | Ehrlich | 36/71 |
| 2,119,807 | A | 6/1938 | Farley | 36/71 |
| 2,246,944 | A | 1/1939 | Larkin | 36/71 |
| 2,156,532 | A | 5/1939 | Greider | 36/2.5 |
| 2,161,565 | A | 6/1939 | Freda | 36/71 |
| 2,221,202 | A | 11/1940 | Ratcliff | 36/71 |
| 2,252,936 | A | 8/1941 | Leydecker | 12/142 |
| 2,255,100 | A | 9/1941 | Brady | 36/71 |
| 2,304,384 | A | 12/1942 | Stemmons | 36/71 |
| 2,346,279 | A | 4/1944 | Stritter | 36/44 |
| 2,379,000 | A | 6/1945 | Gould | 36/8.5 |
| D143,642 | S | 1/1946 | Bouthillette | D7/5 |
| 2,413,534 | A | 12/1946 | Watson | 36/71 |
| 2,423,622 | A | 7/1947 | Samblanet | 36/71 |
| 2,424,107 | A | 7/1947 | McCahan | 36/71 |
| 2,460,493 | A | 2/1949 | Diamant | 36/8.5 |
| 2,505,032 | A | 4/1950 | De Voos | 36/11.5 |
| 2,588,317 | A | 6/1951 | Schwartz | 36/76 |
| 2,628,440 | A | 2/1953 | Leydecker | 36/71 |
| 2,658,288 | A | 11/1953 | Scholl | 36/44 |
| 2,814,133 | A | 11/1957 | Herbst | 36/71 |
| 2,821,032 | A | 1/1958 | Helfet | 36/71 |
| 2,826,834 | A | 3/1958 | Ratcliff | 36/71 |
| 2,828,555 | A | 4/1958 | Ledos | 36/71 |
| 2,863,231 | A | 12/1958 | Jones | 36/71 |
| 2,897,611 | A | 8/1959 | Schaller | 36/30 |
| 2,909,854 | A | 10/1959 | Edelstein | 36/8.5 |
| 2,917,849 | A | 12/1959 | Scholl | 36/8.5 |
| 2,928,193 | A | 3/1960 | Kristan | 36/71 |
| 2,961,780 | A | 11/1960 | McManus | 36/71 |
| 3,058,240 | A | 10/1962 | Osgood | 36/91 |
| 3,068,872 | A | 12/1962 | Elliot | 36/154 |
| 3,084,695 | A | 4/1963 | O'Donnell | 128/615 |
| 3,099,267 | A | 7/1963 | Cherniak | 128/615 |
| 3,165,841 | A | 1/1965 | Rollman | 36/2.5 |
| 3,187,069 | A | 6/1965 | Pincus et al. | 264/45 |
| 3,233,348 | A | 2/1966 | Gilkerson | 36/44 |
| 3,309,797 | A | 3/1967 | Poitras | 36/80 |
| 3,333,353 | A | 8/1967 | Garcia | 36/68 |
| 3,416,245 | A | 12/1968 | Ferreira | 36/44 |
| 3,449,844 | A | 6/1969 | Spence | 36/44 |
| 3,530,489 | A | 9/1970 | Appleton | 36/44 |
| 3,591,882 | A | 7/1971 | Pearsall | 12/146 |
| 3,638,336 | A | 2/1972 | Silverman | 36/44 |
| 3,643,353 | A | 2/1972 | Weight | 36/44 |
| 3,646,692 | A | 3/1972 | Glogg | 36/2.5 |
| 3,680,162 | A | 8/1972 | Glickman | 12/142 |
| 3,730,169 | A | 5/1973 | Fiber | 128/2 |
| 3,781,231 | A | 12/1973 | Janssen et al. | 260/2.5 |
| 3,832,793 | A | 9/1974 | Siskin | 36/2.5 |
| 3,842,519 | A | 10/1974 | Lapidus | 36/44 |
| 3,847,720 | A | 11/1974 | Laberinti | 161/159 |
| 3,935,044 | A | 1/1976 | Daly | 156/79 |
| 3,942,206 | A | 3/1976 | Diamant | 12/142 |
| 4,003,146 | A | 1/1977 | Meier et al. | 36/44 |
| 4,048,732 | A | 9/1977 | Stix | 36/34 |
| 4,054,706 | A | 10/1977 | Shapiro | 428/213 |
| 4,055,699 | A | 10/1977 | Hsiung | 428/311 |
| D246,551 | S | 12/1977 | Hansjosten et al. | D2/320 |
| 4,073,024 | A | 2/1978 | Stix | 12/142 |
| 4,084,333 | A | 4/1978 | Del Vecchio | 36/43 |
| 4,101,704 | A | 7/1978 | Hiles | 428/218 |
| 4,124,946 | A | 11/1978 | Tomlin | 36/43 |
| 4,128,950 | A | 12/1978 | Bowerman et al. | 36/30 |
| 4,137,654 | A | 2/1979 | Hlavac | 36/119 |
| 4,168,585 | A | 9/1979 | Gleichner | 36/95 |
| 4,187,621 | A | 2/1980 | Cohen | 36/44 |
| 4,188,736 | A | 2/1980 | Keller | 36/80 |
| 4,235,026 | A | 11/1980 | Plagenhoff | 36/32 |
| 4,237,626 | A * | 12/1980 | Brown | A43B 7/28 12/146 B |
| 4,240,214 | A | 12/1980 | Sigle et al. | 36/30 |
| 4,266,350 | A | 5/1981 | Laux | 36/44 |
| 4,268,980 | A | 5/1981 | Gudas | 36/43 |
| 4,272,899 | A | 6/1981 | Brooks | 36/129 |
| 4,285,144 | A | 8/1981 | Power | 36/44 |
| 4,291,428 | A | 9/1981 | Anzani | 36/44 |
| 4,292,263 | A | 9/1981 | Hanrahan et al. | 264/469.9 |
| 4,296,053 | A | 10/1981 | Doerer et al. | 264/26 |
| 4,302,892 | A | 12/1981 | Adamik | 36/31 |
| 4,307,521 | A | 12/1981 | Inohara et al. | 36/31 |
| 4,316,335 | A | 2/1982 | Giese et al. | 36/129 |
| 4,317,293 | A | 3/1982 | Sigle et al. | 36/43 |
| 4,320,588 | A | 3/1982 | Sottolana | 36/43 |
| 4,345,387 | A | 8/1982 | Daswik | 36/43 |
| 4,346,205 | A | 8/1982 | Hiles | 528/53 |
| 4,346,525 | A | 8/1982 | Larsen et al. | 36/69 |
| 4,360,027 | A | 11/1982 | Friedlander et al. | 128/581 |
| 4,364,189 | A | 12/1982 | Bates | 36/31 |
| 4,367,599 | A | 1/1983 | Diamant | 36/44 |
| 4,372,059 | A | 2/1983 | Ambrose | 36/32 |
| 4,377,041 | A | 3/1983 | Alchermes | 36/30 |
| 4,378,642 | A | 4/1983 | Light et al. | 36/35 |
| 4,398,357 | A | 8/1983 | Batra | 36/30 |
| 4,408,402 | A | 10/1983 | Looney | 36/43 |
| 4,418,483 | A | 12/1983 | Fujita et al. | 36/28 |
| 4,435,910 | A | 3/1984 | Marc | 36/44 |
| 4,451,949 | A | 6/1984 | Long | 12/146 |
| 4,455,340 | A | 6/1984 | Okina | 428/215 |
| 4,472,890 | A | 9/1984 | Gilbert | 36/28 |
| 4,490,928 | A | 1/1985 | Kawashima | 36/69 |
| 4,494,321 | A | 1/1985 | Lawlor | 36/28 |
| 4,506,462 | A | 3/1985 | Cavanagh | 36/92 |
| 4,510,700 | A | 4/1985 | Brown | 36/44 |
| 4,510,702 | A | 4/1985 | Ehrlich, Jr. | 36/86 |
| 4,513,518 | A | 4/1985 | Jalbert et al. | 36/44 |
| 4,515,851 | A | 5/1985 | Johnson | 428/246 |
| 4,517,981 | A | 5/1985 | Santopietro et al. | 128/581 |
| 4,527,345 | A | 7/1985 | Lopez Lopez | 36/127 |
| 4,541,184 | A | 9/1985 | Leighton | 36/44 |
| 4,541,186 | A | 9/1985 | Mulvihill | 36/114 |
| 4,557,060 | A | 12/1985 | Kawashima | 36/44 |
| 4,564,966 | A | 1/1986 | Chen | 12/146 |
| 4,581,187 | A | 4/1986 | Sullivan et al. | 264/46.4 |

(56) References Cited

U.S. PATENT DOCUMENTS

| | | | | |
|---|---|---|---|---|
| 4,586,273 | A | 5/1986 | Chapnik | 36/44 |
| 4,597,195 | A | 7/1986 | Dananberg | 36/28 |
| 4,608,988 | A | 9/1986 | Dananberg | 128/581 |
| 4,627,177 | A | 12/1986 | Meyers | 36/43 |
| 4,627,178 | A | 12/1986 | Sullivan et al. | 36/44 |
| 4,631,841 | A | 12/1986 | Hickey | 36/91 |
| D288,621 | S | 3/1987 | Surpuriya et al. | D2/961 |
| 4,670,996 | A | 6/1987 | Dill | 36/42 |
| 4,674,204 | A | 6/1987 | Sullivan et al. | 36/44 |
| 4,677,766 | A | 7/1987 | Gudas | 36/43 |
| 4,682,425 | A | 7/1987 | Simmons | 36/44 |
| 4,686,993 | A | 8/1987 | Grumbine | 128/581 |
| 4,689,898 | A * | 9/1987 | Fahey | A43B 5/06 36/144 |
| 4,769,926 | A | 9/1988 | Meyers | 36/43 |
| 4,777,739 | A | 10/1988 | Hiles | 36/43 |
| 4,782,605 | A | 11/1988 | Chapnick | 36/44 |
| 4,798,010 | A | 1/1989 | Sugiyama | 36/30 |
| 4,835,884 | A | 6/1989 | Bianchini et al. | 36/24.5 |
| D302,764 | S | 8/1989 | Peoples et al. | D2/318 |
| 4,852,275 | A | 8/1989 | Bianchini et al. | 36/102 |
| 4,854,057 | A | 8/1989 | Misevich et al. | 36/114 |
| 4,866,860 | A | 9/1989 | Blissett et al. | |
| 4,876,805 | A | 10/1989 | Peoples | 36/43 |
| 4,910,866 | A | 3/1990 | Sullivan et al. | 36/44 |
| 4,932,141 | A | 6/1990 | Hones | 36/43 |
| 4,955,148 | A * | 9/1990 | Padilla | A43B 7/141 36/174 |
| 4,972,612 | A | 11/1990 | Prukop et al. | 36/145 |
| 5,014,706 | A | 5/1991 | Philipp | 128/581 |
| RE33,648 | E | 7/1991 | Brown | 36/44 |
| 5,063,692 | A | 11/1991 | Suginaka | 36/43 |
| D329,129 | S | 9/1992 | Brown | D2/961 |
| 5,146,697 | A | 9/1992 | Weiss | 36/12 |
| 5,174,052 | A | 12/1992 | Sehoenhaus et al. | 36/144 |
| D353,710 | S | 12/1994 | Brazzell | D2/961 |
| 5,373,650 | A | 12/1994 | Dananberg et al. | 36/92 |
| D362,956 | S | 10/1995 | Martin et al. | D2/961 |
| 5,509,218 | A | 4/1996 | Arcan et al. | 36/43 |
| 5,551,173 | A | 9/1996 | Chambers | 36/141 |
| 5,584,130 | A | 12/1996 | Perron | 36/44 |
| 5,632,104 | A | 5/1997 | Zohar | 36/88 |
| 5,685,094 | A | 11/1997 | Lin | 36/141 |
| 5,782,015 | A | 7/1998 | Dananberg | 36/34 |
| 5,787,608 | A | 8/1998 | Greenawalt | 36/11.5 |
| 5,787,610 | A * | 8/1998 | Brooks | A43B 1/0027 36/169 |
| 6,000,147 | A * | 12/1999 | Kellerman | A43B 7/142 36/160 |
| 6,041,524 | A | 3/2000 | Brooks | 36/93 |
| 6,131,311 | A | 10/2000 | Brown et al. | 36/43 |
| 6,253,469 | B1 | 7/2001 | Atlani et al. | 36/174 |
| 6,282,816 | B1 | 9/2001 | Rosendahl | 36/44 |
| 6,412,198 | B1 | 7/2002 | Rothbart | 36/144 |
| 6,510,626 | B1 | 1/2003 | Greenawalt | 36/43 |
| 6,604,301 | B1 | 8/2003 | Manoli, II et al. | 36/43 |
| 6,889,452 | B2 | 5/2005 | Ailey et al. | 36/44 |
| D513,358 | S | 1/2006 | Amado et al. | D2/961 |
| 7,013,583 | B2 | 3/2006 | Greene et al. | 36/28 |
| 7,124,520 | B2 | 10/2006 | Galbraith et al. | 36/43 |
| 7,200,955 | B2 | 4/2007 | Foxen | 36/25 R |
| 7,264,604 | B1 | 9/2007 | Schuren et al. | 602/8 |
| 7,266,913 | B2 | 9/2007 | Axt et al. | 36/174 |
| 7,322,132 | B2 | 1/2008 | Dananberg | 36/174 |
| 7,380,352 | B2 | 6/2008 | Seiter | 36/44 |
| 7,484,319 | B2 | 2/2009 | Cheskin et al. | 36/44 |
| 7,526,882 | B2 | 5/2009 | Rhenter | 36/174 |
| 7,594,346 | B2 | 9/2009 | Dananberg | 36/174 |
| 7,814,688 | B2 | 10/2010 | Dananberg | 36/174 |
| 7,962,986 | B2 | 6/2011 | Dananberg | 12/142 N |
| 8,166,674 | B2 | 5/2012 | Dananberg | 36/43 |
| 9,055,781 | B2 | 6/2015 | Tzeng | |
| 9,460,557 | B1 | 10/2016 | Tran et al. | |
| 2004/0118017 | A1 | 6/2004 | Dalton et al. | 36/44 |
| 2005/0060909 | A1 | 3/2005 | Kerns et al. | 36/28 |
| 2007/0033834 | A1 * | 2/2007 | Cheskin | A43B 7/141 36/44 |
| 2009/0307925 | A1 | 12/2009 | Pfister | 36/28 |
| 2010/0146816 | A1 | 6/2010 | Cappaert | 36/91 |
| 2010/0287795 | A1 | 11/2010 | Van Niekerk | A43B 13/14 |
| 2011/0185590 | A1 * | 8/2011 | Nishiwaki | A43B 5/06 36/28 |
| 2012/0255199 | A1 | 10/2012 | Tzeng | 36/43 |
| 2013/0104423 | A1 | 5/2013 | Hatfield | A43B 5/001 |
| 2013/0205620 | A1 | 8/2013 | Hsu | A43B 7/14 |
| 2013/0247418 | A1 | 9/2013 | Nurse | A43B 3/0031 |
| 2016/0015120 | A1 | 1/2016 | Denison | A43B 3/0094 |
| 2017/0007160 | A1 | 1/2017 | Latterman | A61N 5/107 |
| 2017/0027277 | A1 | 2/2017 | Anthony et al. | A43B 7/14 |
| 2017/0251749 | A1 | 9/2017 | Hughes et al. | A43B 7/141 |
| 2018/0092429 | A1 | 4/2018 | Hughes et al. | A43B 7/141 |

FOREIGN PATENT DOCUMENTS

| | | | |
|---|---|---|---|
| CN | 2770419 | 4/2006 | A43B 13/14 |
| CO | 6930029 | 4/2014 | A43B 3/24 |
| DE | 22803 | 6/1883 | B41B 3/04 |
| DE | 660551 | 3/1938 | A43B 13/00 |
| DE | 875466 | 7/1949 | A43B 7/22 |
| DE | 397602 | 5/1994 | C07C 273/06 |
| EP | 427556 | 5/1991 | A43B 7/08 |
| EP | 591909 | 10/1993 | A43B 7/00 |
| FR | 1163646 | 9/1958 | A43B 13/14 |
| FR | 1207258 | 2/1960 | A43B 13/38 |
| FR | 1413280 | 4/1965 | A43B 13/41 |
| FR | 2015914 | 4/1970 | A43B 13/00 |
| FR | 2272618 | 3/1975 | A43B 7/00 |
| FR | 2309169 | 5/1975 | A43B 7/28 |
| FR | 2427801 | 6/1978 | A43B 21/32 |
| FR | 2506132 | 5/1981 | A41D 27/12 |
| FR | 2522482 | 1/1982 | A43B 17/14 |
| GB | 217833 | 6/1924 | A43B 17/00 |
| GB | 452492 | 11/1934 | A43B 13/38 |
| GB | 1243575 | 8/1971 | A43B 17/14 |
| GB | 1564195 | 4/1980 | C08G 18/06 |
| GB | 2057964 | 4/1981 | B29D 9/06 |
| GB | 2088776 | 6/1982 | B32B 5/18 |
| HU | 209 953 | 2/1995 | A43B 13/40 |
| JP | 10-234417 | 8/1998 | A43B 17/00 |
| JP | 2001-523981 | 11/2001 | A43B 13/12 |
| WO | WO 91/07152 | 5/1991 | A61F 5/14 |
| WO | WO9200714 | 1/1992 | |
| WO | WO 98/14083 | 4/1998 | A43B 7/16 |
| WO | WO9818358 | 5/1998 | A43B 7/22 |
| WO | WO 2004/012548 | 2/2004 | A43B 7/22 |
| WO | WO 2004/093584 | 4/2004 | A43B 7/38 |
| WO | WO2006043923 | 4/2006 | A43B 19/00 |
| WO | WO 2010/085485 | 7/2010 | A43B 13/14 |
| WO | WO2011017174 | 2/2011 | A43B 13/38 |
| WO | WO2016/178638 | 10/2015 | |
| WO | WO2016/185400 | 11/2016 | G06Q 30/02 |

OTHER PUBLICATIONS

"Shear Madness" Footwear News, vol. 53, No. 15 (2 pgs).

EP Communication dated Dec. 23, 2008 in EP Application No. 04 795 016.7, 5 pgs.

International Preliminary Report on Patentability issued in application No. PCT/US2004/033795, dated Apr. 26, 2007 (8 pgs).

International Search Report and Written Opinion issued in application No. PCT/US04/10925, dated Mar. 8, 2005 (7 pgs).

International Search Report and Written Opinion issued in application No. PCT/US2004/033795, dated May 27, 2005 (16 pgs).

International Search Report and Written Opinion issued in application No. PCT/US16/33964, dated Aug. 31, 2016 (10 pgs).

Korean Office Action issued in application No. 10-2007-7010683, dated Sep. 29, 2011 (9 pgs).

Korean Office Action issued in application No. 10-2010-7022406, dated Oct. 19, 2011 (11 pgs).

Notice of Allowance issued in U.S. Appl. No. 10/964,532, dated Sep. 11, 2007 (9 pgs).

(56) References Cited

OTHER PUBLICATIONS

Notice of Allowance issued in U.S. Appl. No. 12/489,328, dated Aug. 30, 2010 (9 pgs).
Notice of Allowance issued in U.S. Appl. No. 12/489,328, dated Jul. 1, 2010 (16 pgs).
Notice of Allowance issued in U.S. Appl. No. 12/827,444, dated. Dec. 14, 2010 (11 pgs).
Notice of Allowance issued in U.S. Appl. No. 12/827,444, dated Feb. 17, 2011 (7 pgs).
Notice of Allowance issued in U.S. Appl. No. 29/196,782, dated May 16, 2005 (6 pgs).
Notice of Allowance issued in U.S. Appl. No. 29/196,783, dated May 16, 2005 (6 pgs).
Notice of Allowance issued in U.S. Appl. No. 29/196,784, dated May 16, 2005 (6 pgs).
Notice of Allowance issued in U.S. Appl. No. 29/227,099, dated. Jun. 19, 2006 (16 pgs).
Office Action dated Apr. 28, 2010 issued in related Mexican Patent Application No. MX/a/2007/004383 (2 pgs).
Office Action dated Feb. 15, 2008 issued in related Chinese Patent Application No. 200480044477.4 (7 pgs, with translation).
Office Action dated Nov. 1, 2010 issued in related Chinese Patent Application No. 200910150976.6 (7 pgs, with translation).
Office Action dated Nov. 21, 2008 issued in related Chinese Patent Application No. 200480044477.4 (6 pgs, with translation).
Office Action dated Nov. 4, 2009 issued in related Japanese Patent Application No. 2006-509840 (7 pgs, with translation).
Office Action dated Oct. 2, 2007 issued in related EPO Patent Application No. 04 737 224.8 (3 pgs).
Office Action issued in U.S. Appl. No. 10/421,403, dated Dec. 14, 2004 (6 pgs).
Office Action issued in U.S. Appl. No. 10/964,532, dated Apr. 13, 2007 (22 pgs).
Office Action issued in U.S. Appl. No. 12/489,328, dated May 20, 2010 (15 pgs).
Office Action issued in U.S. Appl. No. 1.5/057,925, dated Apr. 12, 2017 (5 pgs).
Office Action issued in U.S. Appl. No. 1.5/057,925, dated Feb. 9, 2017 (15 pgs).
Office Action issued in U.S. Appl. No. 15/057,925, dated May 19, 2017 (15 pgs).
Office Action issued in U.S. Appl. No. 15/057,925, dated Nov. 29, 2017 (5 pgs).
Office Action issued in U.S. Appl. No. 15/057,925, dated Nov. 21, 2016 (29 pgs).
Office Action issued in U.S. Appl. No. 15/057,925, dated Sep. 22, 2017 (17 pgs).
Official Action received in Applicant's related European Patent Application Serial No. 04737224.8, dated Sep. 13, 2010 (5 pgs).
Official Action received in Applicant's related Japanese Patent Application Serial No. 2006-509840, dated Jun. 22, 2010 (5 pgs).
Official Action received in Applicant's related Japanese Patent Application Serial No. 2007-536664, dated Aug. 10, 2010 (6 pgs).
Plastic Insole from Standing Ovation TM Shoes by HBN Shoe, LLC,1997; PAIR acknowledged receipt of item on Apr. 12, 2004, U.S. Appl. No. 29/196,783 (copy of the "Artifact Sheet indicating an item has been filed which cannot be scanned" (dated Mar. 8, 2004) is provided in lieu of the original Plastic insole) (1 pg).
Office Action issued in corresponding U.S. Appl. No. 15/057,925 dated Jan. 10, 2018, 25 pgs.
U.S. Appl. No. 15/905,482, filed Feb. 26, 2018.
"A Manual of Lower Extremities Orthotics", ed. Miles H. Anderson, pp. 109-11, 1972.
"Anthropometry of the Foot and Lower Leg of U.S. Army Soldiers: Fort Jackson, SC—1985" NATICK/TR-92/028. Natick, Ma: U.S. Army Natick Research, Development, and Engineering Center (ADA261405), 1992 (360 pgs).
"Common Foot Disorders: Diagnosis and Management", ed. Donald Neale, pp. 44-47, 52-54, 65-66, 192-194, 1981.
"Lower Limb Orthotics: 1981 Revision", Prosthetics and Orthotics Department, New York University, Post-Graduate Medical School, pp. 172-179, copyright 1981.
"Mechanical Foot Therapy", Philip R. Brachman (The Leicht Press) pp. 292-295, 1946.
"Podopediatrics—The Care of Childrens Feet" by Herman R. Tax, B.S., Pod.D., Copyright 1947 ("Manual"), pp. Forward and 101-105 and 108-110.
Chinese Search Report/Office Action (and translation) issued in related application No. 201080002797.9, dated Feb. 8, 2014 (40 pgs).
European Search Report issued in related application No. 10150628.5, dated Feb. 21, 2014 (5 pgs).
Herman R. Tax, D.P.M., "Podopediatrics", 1980, pp. 189, 221-242.
International Preliminary Report on Patentability issued in corresponding application No. PCT/US2011/042044, dated Jan. 8, 2013 (8 pgs).
International Preliminary Report on Patentability, PCT/US2010/043578, dated Feb. 7, 2012 (11 pgs).
International Search Report and Written Opinion, PCT/US2010/043578, dated Sep. 24, 2010 (15 pgs).
International Search Report and Written Opinion, PCT/US2011/042044, dated Feb. 7, 2012 (9 pgs).
Japanese Official Action (and translation) issued in related application No. 2012-523655, dated Jul. 31, 2014 (5 pgs).
Merton L. Root, D.P.M.; William P. Orien, D.P.M.; and John H. Weed, D.P.M.; normal and abnormal Function Of The Foot, 1977, Clinical Biomechanics, vol. II, pp. 355-367.
Office Action issued in U.S. Appl. No. 15/356,256, dated Apr. 26, 2017 (32 pgs).
Office Action issued in U.S. Appl. No. 15/356,256, dated Feb. 23, 2017 (19 pgs).
Taiwanese Official Action (and translation) issued in related application No. 99125770, dated Mar. 27, 2015 (37 pgs).
Taiwanese Official Action (and translation) issued in related application No. 99125770, dated May 21, 2015 (22 pgs).
International Preliminary Report on Patentability for related International Patent Application Serial No. PCT/US2016/033964, dated Sep. 4, 2018, 7 pages.
European Search Report issued in application No. 16892908.1, dated Dec. 20, 2018 (10 pgs).
International Search Report and Written Opinion issued in application No. PCT/US18/62086, dated Feb. 11, 2019 (12 pgs).
Office Action issued in U.S. Appl. No. 15/057,925, dated Jan. 11, 2019 (20 pgs).
Columbia Office Action (w/translation) issued in application No. NC2018/0006210, dated May 21, 2019 (18 pgs).
Office Action issued in U.S. Appl. No. 15/057,925, dated May 1, 2019, 2019 (28 pgs).
South Africa Acceptance of Complete Specification issued in application No. 2218/03211, dated May 23, 2019 (1 pg).
U.S. Appl. No. 15/057,925, filed Mar. 1, 2016.
U.S. Appl. No. 15/356,256, filed Nov. 18, 2016.
Office Action issued in U.S. Appl. No. 15/057,925, dated Apr. 20, 2018 (18 pgs).

* cited by examiner

III 136
138
138
136
135
130
135
140
140
III

DEVICE FOR HIGH-HEELED SHOES AND METHOD OF CONSTRUCTING A HIGH-HEELED SHOE

CROSS REFERENCE TO RELATED APPLICATION

This application is a continuation-in-part (CIP) of our co-pending application Ser. No. 15/057,925, filed Mar. 1, 2016.

STATEMENT REGARDING FEDERALLY SPONSORED RESEARCH OR DEVELOPMENT

Not applicable

BACKGROUND OF THE INVENTION

The present invention relates to a shoe that is easily constructed and provides greater comfort to the wearer without affecting the fit or style of the shoe. The invention has particular utility in connection with high-heeled shoes and will be described in connection with such utility, although the invention also has utility in connection with low heel footwear products as well.

Conventional high-heeled shoes have a reputation for being extremely uncomfortable. There is survey information indicating that as many as 20% of the users of such shoes experience foot pain related to the shoes immediately, and the majority of users experience such pain after as little as four hours of use.

In order to understand the prior art and the present invention, it is necessary to understand the anatomy of the foot and the basics of shoe construction. To that end, FIG. 1 is a diagrammatic view of the bones of the foot and the portions of a shoe that underlie the sole of the foot. By reference to FIG. 1, the following briefly describes the anatomy of the foot and the basics of shoe construction.

FIG. 1 is a diagrammatic medial side view of the bones of the human foot 10. For purposes of this application, references to rearward mean in the direction of the rear of the foot or heel 20; references to forward or toeward mean in the direction of the front of the foot 30 where the toes or phalanges 31 are located; references to medial mean the side of the foot where the arch 40 is located; references to lateral mean the outside of the foot; and references to upper or top and lower, bottom or under assume the foot or shoe is oriented in an upright position.

The heel 20 (also known as the tarsus) includes the talus 21 and the calcaneus 22 bones. The rear lower surface of the calcaneus 22 has a slight protuberance 23 known as the calcaneal tuberosity.

Referring to FIG. 1A, the calcaneus is an irregularly shaped quadrangular bone also called the heel bone or os calcis. As can be seen particularly in FIG. 1A, the medial side of the calcaneal tuberosity, i.e. the lower part of the posterior surface of the calcaneus is not precisely on the same ground or plane as the lateral tuberosity. This slight difference in calcaneal anatomy leads to ankle instability particularly for wearers of high heel shoes.

The bones of the foot also include the navicular 41, the cuneiform 42, the metatarsals 45 and the phalanges, or toes, with the big toe 31 visible in FIG. 1. The metatarsal heads 46 are located at the forward end of the metatarsal shafts 47. The metatarsals are numbered 1 to 5, with 1 designating the big toe.

Also depicted in FIG. 1 is a partially exploded view of the portions of a conventional high-heeled shoe 50 that underlie the sole of the foot. Shoe 50 has a heel 51 which is generally attached to the lower surface of sole 52 of shoe 50, with the sole 52 in turn supporting the insole board 53 on which the sock liner 54 is placed. In a conventional shoe, the insole board is typically of relatively rigid construction from the region underlying the wearer's heel to the heads of the metatarsals. Sock liners are commonly very flexible and generally arc very thin, typically no more than half a millimeter thick. The sock liner is the surface upon which the sole of the foot normally rests.

According to conventional shoe construction methods, the last is the form around which the shoe is constructed. During manufacture, the lower surface of the last sits on the upper surface of insole board, and the shoe upper is then shaped around the last and attached to the insole board. Optimally, the lower surface of the last and the upper surface of the insole board fit together smoothly in order to properly manufacture shoes. If there is any convexity on the lower surface of the last or the upper surface of the insole board respectively, a corresponding concavity must be present in the insole board or last respectively. To be assured of a quality shoe construction, any such convexity and corresponding concavity must be carefully aligned during shoe manufacture, thereby introducing added complexity and/or quality control issues to shoe manufacture.

As will be appreciated, a conventional high-heeled shoe such as shown in FIG. 1 places the rearward part of the wearer's foot essentially on an inclined plane. As a result, the foot is urged forward by gravity into the toe box in standing or walking. This results in pressure on the ball or forefoot regions and toe jamming which often gives rise to a burning sensation in these areas of the foot, as well as fatigue and discomfort in the foot and other areas of the body.

Numerous suggestions have been made for improving the comfort of high-heeled shoes, including suggestions in my prior patents and publications. For example, in a February 1990 article in Current Podiatric Medicine, pp. 29-32, I described a high-heeled shoe design in which the portion of the shoe under the heel does not form a continuous ramp down the arch to the ball of the foot, but rather the portion underlying the heel is relatively parallel to the ground. The design used a rigid plastic molded midsole which was cupped to receive the heel and angled to bring the heel into a plane more parallel with the floor. In addition, a metatarsal pad was incorporated into the molded midsole.

In U.S. Pat. No. 5,373,650, I described a rigid or semirigid orthotic under the heel and extending forward, with arch support, to a point behind the metatarsal heads of the foot. The heel in this device is supported parallel to the ground or tilted slightly backwards.

In U.S. Pat. No. 5,782,015, I described a high-heeled shoe design in which the heel is positioned more parallel or slightly downwardly inclined angle relative to the shank plane and which has an arch support that supports the head of the navicular in approximately the same plane as the wearer's heel bones. My PCT Publication WO98/14083, published Apr. 9, 1998, describes a rigid molded device comprising a heel cup and an anatomically shaped arch appliance.

Numerous examples of designs by others intended to improve comfort of high-heeled shoes exist in the prior art. U.S. Pat. Nos. 1,864,999, 1,907,997, 4,317,293, 4,631,841, 4,686,993, 4,932,141 and 6,412,198 each describes shoe inserts or orthotics intended to improve comfort of a high-heeled shoe. Several involve arch supports. Some are rigid; others suggest cushioning as a means to improve comfort. The prior art inserts and orthotics typically are relatively bulky and can affect a shoe's fit if added by the wearer after manufacture. Other prior art proposals to improve wearer comfort require that each last used to manufacture the shoe be modified to change the shape of the shoe itself.

These prior art constructions improve comfort by supporting or cushioning parts of the foot and/or altering the foot angles to reduce sliding forward and/or to alter the percentage of the wearer's weight borne by different parts of the foot. Their teachings suggest, among other things, placing the heel on a more level plane to shift the weight backward onto the heel, supporting the arch, angling the toes upward and/or cushioning the surfaces on which the largest percentage of weight is borne.

The foregoing discussion of the prior art derives primarily from my earlier U.S. Pat. No. 7,322,132 in which I provide a thin flexible shoe insert which readily can be adapted to any style shoe and which can be incorporated into a shoe without requiring modifications to a shoe last or adding manufacturing complexity. The insert has two slightly raised areas under the heel and the metatarsals. Although the insert has two only slightly raised areas, it significantly increases wearer comfort even in very high heels. The insert does not require that the heel be repositioned to a plane parallel with the floor as is the case in some of the prior art. Other than in the two slightly raised areas, the insert can be extremely thin, thereby minimizing any effect on fit of the shoe and eliminating any adverse effect on the style or appearance of the shoe. Alternatively, the thin flexible insert can be placed in the shoe by the wearer. See also my U.S. Pat. Nos. 7,595,346, 7,814,688 and 7,962,986.

BRIEF SUMMARY OF THE INVENTION

While high heel shoes in accordance with my aforesaid U.S. '132, '346, '688 and '986 patents enjoy considerable commercial success and are available from a number of manufacturers in numerous countries, I have found that changing the shape of the heel region to better accommodate the plantar surface of the calcaneal tuberosity, comfort and ankle stability is unexpectedly and significantly improved for both high-heeled shoes, as well as low heel shoes and flats. More particular, the present invention provides a device for insertion into heeled shoes and the corresponding method of constructing shoes using the device. The device comprises a rear region positioned to underlie the calcaneal tuberosity the wearer. The rear region is shaped to accommodate the plantar surface of the calcaneal tuberosities and includes first and second essentially ellipsoid shaped depressions to accommodate the calcaneal tuberosity of the wearer. The first depression, on the medial/inside of the device, i.e., under the medial tuberosity, is the larger of the two depressions, and is slightly deeper than the second depression on the lateral/outside of the device. Typically the depression on the medial/inside is 2-5 times larger than the depression on the lateral/outside preferably 2-4 times larger, more preferably 2½-3 times larger, most preferably about 2.7 times larger in plan, and the base level of the depression under the lateral tuberosity is slightly higher, e.g., about 0.1-3 mm higher, more preferably 0.1-2 mm higher, most preferably about 0.3 mm higher over the base level of the depression under the medial tuberosity to accommodate the calcaneal tuberosity of the wearer. The toeward portions of the first and second depressions gradually rise to crescent shaped apices lying under the area forward of the tuberosity of the calcaneus. The device also includes a forward region positioned to underlie at least a portion of the shafts of the metatarsals, the upper surface of said forward region having a portion which gradually rises to an apex positioned to underlie the shafts of the second and third metatarsals. In the preferred embodiment, the device has a bridging or middle region which connects the forward and rear regions, the device is flexible and the upper surface of the device is smoothly contoured between all regions. A feature and advantage of the device of the present invention is that the device may universally be applied to conventional heeled shoes without the need to otherwise modify the shoes or the shoe last. A shoe may be constructed with the device according to the present invention by incorporating the device into the shoe during the manufacturing process or the device may be applied post-manufacture by the wearer.

DETAILED DESCRIPTION OF THE INVENTION

As used herein "heeled shoes" shall include high heeled shoes, low heeled shoes and flats. The present invention provides a device which improves comfort and is easily installed in heeled shoes. For purposes of this invention, it is to be understood that heeled shoes include all footwear having a heel which is about one inch or higher. The benefits of the invention are achieved when a device is positioned in a shoe to underlie the metatarsal shafts and calcaneus of the wearer. Typically, the device is positioned on the insole board or sock liner of a heeled shoe. Preferably, the device is sufficiently flexible so that it readily conforms to the upper surface of the insole board or sock liner on which it is positioned. The device may be formed of any materials known to those of ordinary skill in the art that can be molded or shaped and that will produce a device flexible under normal conditions of use of a shoe, while retaining sufficient dimensional stability to retain the benefit of the invention.

In the preferred embodiment, the device is shaped to underlie at least (i) the portion of the heel extending from the edge of the tuberosity of the calcaneus to the portion of the heel that is immediately forward of the tuberosity of the calcaneus, and (ii) the area under the second and third metatarsal shafts. The device may extend beyond these areas and may be shaped to conform to the shape of the sock liner or insole board. Optimally, the device is narrower than the sock liner when it is to be positioned under the sock liner. This narrower size allows the edge of the sock liner to be adhered to the insole board along the edges of the device of the invention. Depending on the style of the shoes this narrower configuration may be particularly desirable.

The device has two distinct areas: a first distinct heel area that underlies the calcaneal tuberosities of the wearer, and which has two depressed areas shaped generally to accommodate respectively the lateral and medial tuberosities of the wearer's calcaneal anatomy. The depressed areas rise from their respective forward edges of the tuberosity of the calcaneus to a crescent-shaped apices underlying the calcaneus in the area forward of the tuberosity of the calcaneus of the wearer's foot. The device also includes a second distinct raised area located within a shoe to underlie the metatarsal shafts of the wearer's foot, with its apex under or between the second and third metatarsal shafts. The first and second raised areas are joined by a bridging or middle region. For clarity, it is to be understood that references to narrow and wide mean the side-to-side dimensions of the shoe or device while references to raised, lowered, thinness, depth or height mean the vertical dimensions of the device.

Figure 1A:
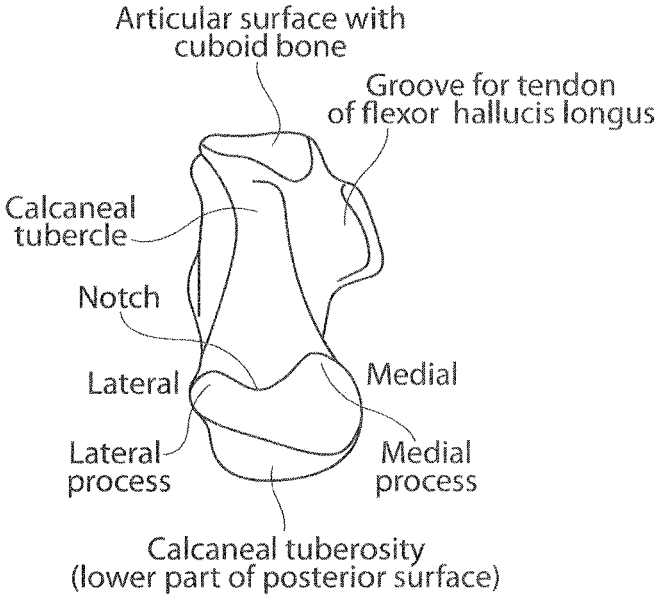
FIG. 1A Prior Art
FIG. 1A is a rear view of the calcaneus.
Figure 1:
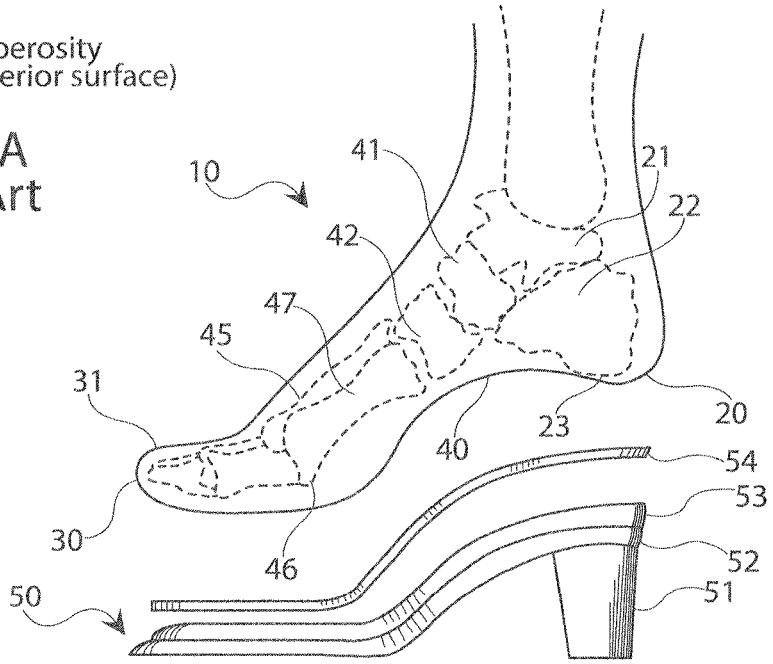
FIG. 1 Prior Art
FIG. 1 is a diagrammatic cross-sectional view of the foot bones and a partially exploded view of the portions of a conventional high-heeled shoe that underlie the sole of the foot.
Figures 2A, 2B:
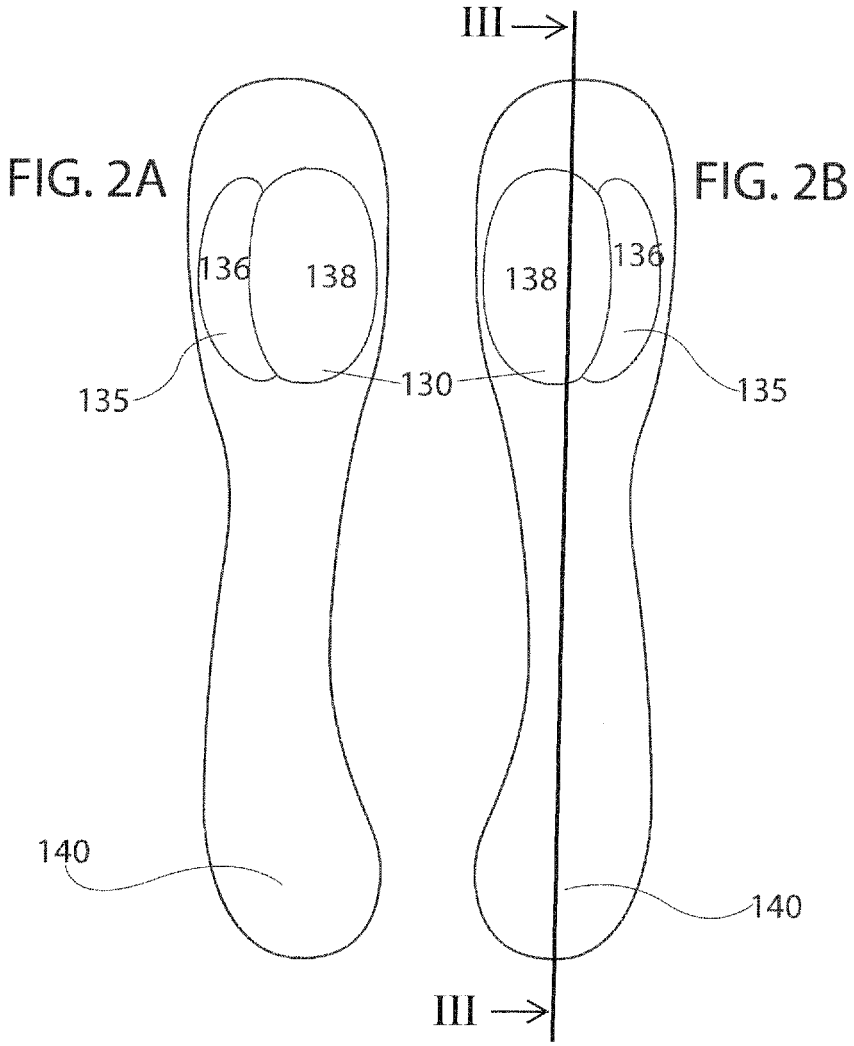
FIGS. 2A and 2B are top plan views of an embodiment of the device of the present invention showing right (FIG. 2A) and left (FIG. 2B) shoe devices.
Figure 3:
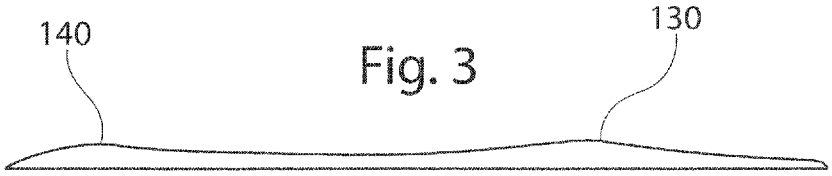
FIG. 3 is a side cross-sectional view of the device of the present invention shown in FIG. 2B, taken along plane "III-III."
Figure 4:
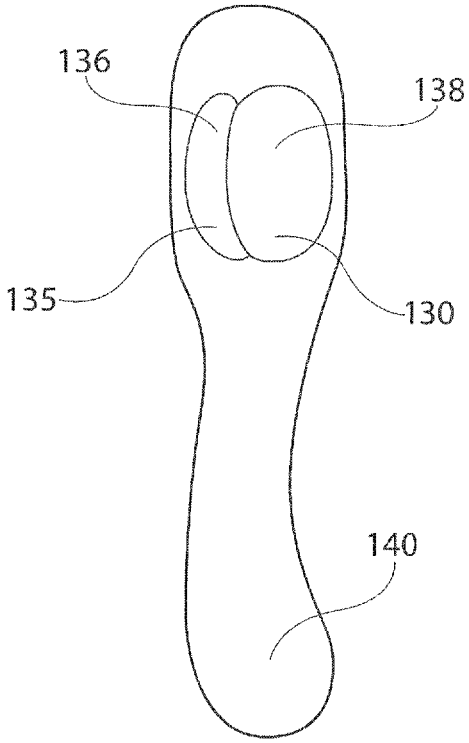
FIG. 4 is a contour drawing of the device of FIG. 2A.
Figure 5:
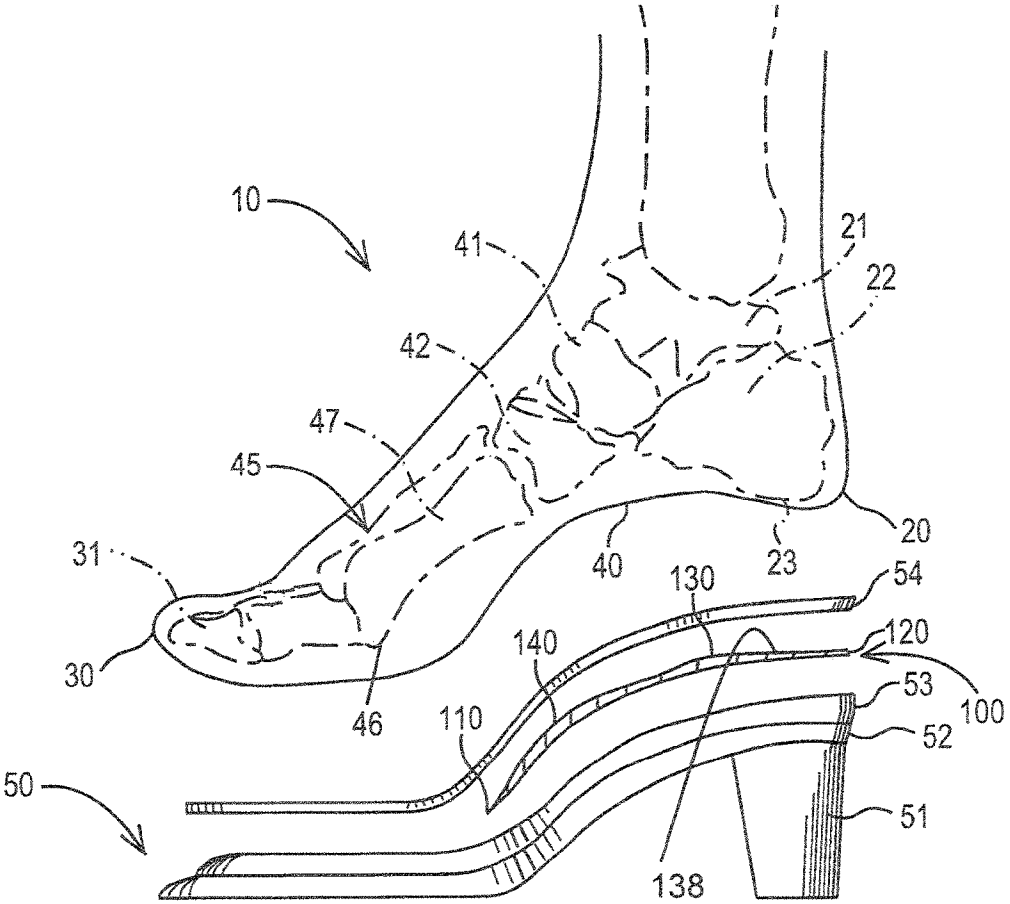
FIG. 5 is a diagrammatic cross-sectional view of the foot bones and a partially exploded view of the portions of a conventional high-heeled shoe that underlie the sole of the foot into which the device of the present invention shown in FIG. 2 has been inserted.

FIGS. 2-5 illustrate an exemplary embodiment of a device 100 consistent with the invention. The device 100 is formed from a flexible material, e.g., molded flexible plastic or rubber, such as polyurethane, thermoplastic elastomer (TPE), thermoplastic rubber (TPR), polyvinyl chloride (PVC) or ethylene vinyl acetate (EVA). The raised areas of the device have a Shore A hardness between about 15 and 70, and preferably have a Shore A hardness of about 20 to 50, and most preferably about 35. The entire device preferably but not necessarily is of the same hardness. The device 100 has a forward region 110 and a rear region 120. The device includes three raised areas 130, 135 and 140. Raised areas 130 and 135, located in the rear region, are generally crescent-shaped and positioned in a shoe to underlie the area immediately in front of the tuberosity 23 of the heel bone or calcaneus 22 of the wearer's foot. The crescent-shaped raised areas 130 and 135 rise from depressions as will be described below found in the heel portion of the device so that the crescents are oriented as shown in FIGS. 2-5.

Referring in particular to FIGS. 2A-2B, FIG. 3 and FIG. 4, the device includes a lop-sided generally cardioid shaped depression including a first depressed area 136 located directly under the lateral tuberosity of the wearer's calcaneal anatomy, and a second depressed area 138 located under the medial tuberosity of the wearer's calcaneal anatomy. The base level of depressed area 136 under the lateral tuberosity is slightly higher, typically about 0.1-3 mm higher, preferably about 0.1-2 mm higher, most preferably about 0.3 mm higher, over the base level of depressed area 138 under the medial tuberosity to accommodate the calcaneal tuberosity of the wearer. Depressed area 138 under the medial tuberosity is 2-5 times larger in plan, preferably 2-4 times larger, more preferably 2½-3 times larger, most preferably about 2.7 times larger in plan, than the area 136 under the lateral tuberosity. Both depressed areas 136 and 138 are generally ellipsoid in shape. More particularly, the first and second depressed areas 136, 138 can be described as first and second depressed areas defined by the Boolean subtraction of the larger of two 3D ellipses from the smaller, the larger ellipse being 40 to 120 percent larger in volume than the smaller ellipse, preferably 60 to 100 percent larger in volume, more preferably about 80 percent larger in volume than the smaller ellipse with larger skewed to the medial side and the smaller skewed to the lateral, with the intersecting volume being 10 to 30 percent of the larger, more preferably about 20 of the larger, with the longer axis of both aligned with the heel/toe direction of the device, and with the medial/lateral axis of the smaller skewed slightly to the rear of the larger, and both rotated such that the toe-ward end is raised 1 to 10 degrees, preferably 3 to 8 degrees, more preferably about 5 degrees relative to the heel-ward end, such depressions being configured to accommodate respectively the lateral and medial tuberosities of the wearer's calcaneus.

A third raised area 140 is located in the forward region of the device which is canted to the medial side, and is positioned to underlie the metatarsal shafts 47 of the wearer's foot. Optimally, the apex of the third raised area 140 is located under or between the second and third metatarsal shafts. The third raised area 140 comprises a generally rounded or ellipsoid shape that rises to an apex in the toeward direction of the metatarsal heads. The forward raised area 140 preferably has a thinner aspect located towards the heel end and a wider aspect located towards the toeward end. Since the device includes a lop-sided section under the heel region, and the toeward region is canted to the medial side, the device is left/right shoe specific, the left and right pieces being mirror images of one another.

The apices of raised areas 130, 135 and 140 are 2 to 8 mm higher relative to the bottom surface of the device and, preferably 2 to 6 mm higher, more preferably 2.5 to 4.5 mm, most preferably about 3.8 mm higher relative to the bottom surface of the device measured immediately forward of the forward raised area under the metatarsal shafts and immediately rearward of the raised areas under the calcaneus. In a particularly preferred embodiment each apex 130, 135 and 140 is approximately 3.3 mm high for a US size 1 women's shoe, approximately 3.9 mm higher for a US size 6 woman's shoe, and approximately 5.2 mm for a US size 16 women's shoe high relative to the bottom surface of the device (or their equivalents in other, e.g. English, European and Japanese shoe size scales) having a heel height of 1 to 5 inches. A bridge area 160 separates depressed areas 136 and 138, and is also depressed relative to the upper surface of the device surrounding the depressed areas 136 and 138. In the preferred embodiment the apices 130, 135 and 140 are of similar or the same height. Preferably, each apex 130, 135 and 140 is higher for higher heeled shoes and lower for lower heeled shoes. Also, each apex 130, 135 and 140 preferably is lower for smaller sized shoes and higher for larger sized shoes. The size of raised areas 130, 135 and 140 also changes somewhat with shoe size with the size of the area increasing with increasing length and/or width. Typically, the size of the raised areas both in terms of height and area is scaled to the shoe size with normal rules of scaling applying as the length and width of the shoes increases with increasing size. However, it has been found that a small range of sizes can use an identical device without significant loss of the improved comfort associated with the device. The critical factor on the comfort achieved with the device of the invention appears to be the location of the two raised regions—under the calcaneus but forward of the tuberosity of the calcaneus, and under the middle metatarsals but rearward of the heads of the metatarsals, and the size and location of the depressed areas under the calcaneus tuberosity.

Heel size from individual to individual typically varies far less than other aspects of foot dimensions. Accordingly, the depressed areas 136 and 138 under the calcaneus tuberosity may be made essentially the same for all foot sizes provided the area under the medial tuberosity 138 is far larger than under the lateral tuberosity 136, and the base level of the depressed area 136 under the lateral tuberosity is somewhat higher over the base level of the depressed area 137 under the medial tuberosity. The proximal and the distal ends of the device, i.e., underlying the back of the heel and forward of raised area 140 are thin relative to the raised areas. Preferably these proximal and distal ends have a depth that results in their being flush with the upper surface of the shoe upper where it wraps around the upper surface of the insole board. Preferably the ends are also shaped to conform somewhat to the area extending between the edges of the upper that lie on the surface of the insole board. The thickness of these ends of the device typically will be from 0.2 to 1 mm thick.

The bridging or middle section or area of the device between the first raised areas 130, 135 and the second raised area 140 is also preferably thin relative to the raised areas. The thickness of this area is in part dictated by issues of structural integrity during the manufacturing process for the shoe. With stronger materials this area can, and ideally should be, no more than a millimeter thick. In general, this bridging or middle section or area must be thinner than the raised areas 130, 135 and 140, and preferably is no more than about 4 millimeters thick, more preferably about 2 mm thick for a US size 6 women's shoe and about 2½ mm for a US size 10 women's shoe (or their equivalents in other size scales). This thinner bridging or middle region allows the device to more easily conform to the shape of the insole. The minimum width of this bridging or middle region is also dictated by manufacturing considerations with the optimal minimum width being that which will maintain the geometry of the forward and rear regions relative to each other. The maximum width is that which will not interfere with the appearance of the shoe. Preferably this bridging or middle region is narrower than the sock liner 54 and, like the ends of the device, the bridging or middle region sits flush with the upper surface of the upper that wraps around the insole board and generally conforms to the shape of the area created by the edges of the upper on the insole board.

It should be noted that, contrary to the teachings of the prior art, rather than providing a raised area for supporting the arch of the wearer's foot in the device of the present invention, at least a portion of the bridging or middle region underlying the arch is thinner than the apices of the first and second raised areas 130, 140. That is to say, where a traditional arch support normally would be located in the shoe at least a portion of the area underlying the arch of the foot is hollowed or lower than adjacent areas leaving the arch unsupported in part.

Preferably, the upper surface of the device is smoothly contoured, with no sharp transitions or edges that could contribute to discomfort. Specifically, the transition between the apices of the raised areas and the surrounding areas of the device are filleted and smooth.

Figures 6A, 6B:
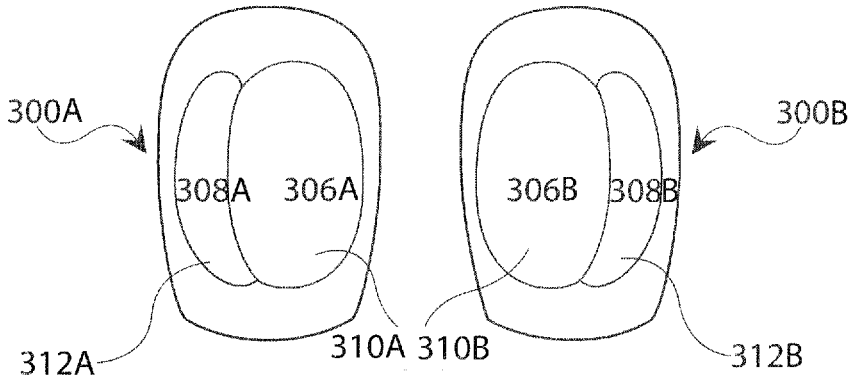
FIGS. 6A-6D are views, similar to FIGS. 2A and 2B, of an alternative embodiment of the invention.
Figures 6C, 6D:
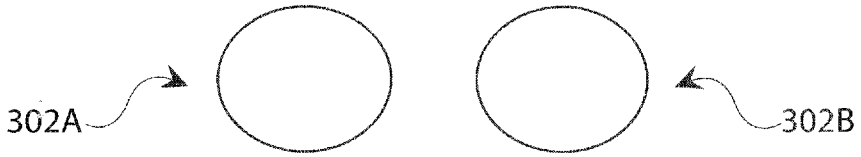

As described above, the invention contemplates a single flexible device into which both raised areas are incorporated. As shown in FIGS. 6A-6D, the invention also contemplates two separate flexible devices, a heel area elements 300A/300B and metatarsal area elements 302A/302B, which together achieve the advantages of the invention. More specifically, FIGS. 6A-6D show an alternative embodiment of the device in which the metatarsal elements 302A/302B have raised areas 304A/304B similar to raised area 140 of the FIG. 2A/2B embodiment, and the heel area elements 300A/300B have depressed areas 306A/306B and raised areas 310A, 310B, 312A, 312B, similar to depressed 138/136 and 130/135 of the FIG. 2A/2B embodiment. In the FIG. 6A-6D embodiment, the heel piece, and the metatarsal piece are individually positioned in a shoe. In that case, the region between the two pieces of the device is integral with the insole board or the sock liner and need not be flexible. A further manufacturing alternative is to incorporate one or both of the heel portion and metatarsal piece into the insole board. Yet a further alternative is to incorporate one or both of the heel portion and the metatarsal piece into a sock liner. However, for ease of manufacture, a single device having the separate raised areas joined by a bridging or middle section is preferred. In all cases, the portions of the device that are mounted on the insole board of a shoe must be flexible enough to readily conform to the upper surface of the insole board on which they are mounted. The invention also contemplates a single flexible device which embodies one or the other of the above raised areas and which is used in conjunction with a shoe or shoe part which incorporates the other raised area. The invention also contemplates using only the heel area element 300 as a heel cup. This latter embodiment has particular utility in sport shoes, particularly where the wearer is subjected to a lot of lateral movement, such as tennis and basketball. Finally, the invention contemplates shoes into which any of the foregoing described embodiments of the device has been incorporated.

The device 100 preferably is positioned in shoe 50 during the manufacturing process. Accordingly, this invention also provides a method of constructing a heeled shoe comprising: (a) assembling an upper, insole board and sole; (b) mounting above the insole board a flexible device comprising (i) a rear region positioned with its depressed areas to underlie the calcaneus tuberosity of the wearer; (ii) a forward region positioned to underlie at least a portion of the shafts of the metatarsals, the upper surface of said forward region having a portion which gradually rises to an apex positioned to underlie the shafts of the second and third metatarsals from a position behind the heads of metatarsals; (iii) a bridging or middle region which connects said forward and rear regions; and (iv) the upper surface of said device transitioning smoothly between all regions; and (c) affixing a sock liner to the insole board and to the device. The order in which these steps are done is the choice of the manufacturer. In a preferred embodiment of the invention, the device 100 is positioned on the insole board 53 of the shoe 50, and then a sock liner 54 is adhered to the top of the insole board and the device 100. It is also contemplated that the device 100 may be installed post-manufacture or post-sale in certain embodiments, e.g., by being placed on the insole hoard 53 or sock liner 54 post-manufacture. The device 100 may be attached to the insole board 53 and the sock liner 54 through means such as glue, pressure-sensitive adhesive (PSA), hook and loop fasteners, or mechanical fasteners such as nails or staples. In general, any means that will cause the raised areas of the device to remain in position may be used to position the device in the shoe. Device 100 also need not be separate from the sock liner but may be integral with the sock liner.

In order to facilitate proper positioning of the device, the device may be provided with markings or structures that orient the device. These markings may be arrows or the device itself may be configured with points which serve to orient the device.

The device of the present invention provides unexpected advantages over the prior art. For example, although the device is only a few millimeters thick, the device causes the weight borne by the foot to be significantly shifted towards the heel and off the ball of the foot. As a result, the device reduces toe pain and general lower back pain associated with the wearing of heeled shoes. Thus, foot pain, endemic with the use of heeled shoes including specifically high-heeled shoes, is reduced or eliminated using the instant device. The device also improves ankle stability.

In addition, this device does not require any change in the lasts used to manufacture conventional shoes; rather, the device can simply be placed into the conventionally constructed shoe either by the manufacturer or by the wearer. Nor does this device significantly affect the fit of the shoe as it does not intrude substantially into the shoe and thereby diminish the space available for the foot.

The invention claimed is:

1. A device for insertion into a heeled shoe, the device comprising:

a rear region having a foot supporting surface configured to underlie a wearer's calcaneal tuberosities;

a forward region having a foot supporting surface configured to underlie at least a portion of the shafts of the wearer's metatarsals;

a lateral side; and a distal side;

wherein the rear region foot supporting surface includes first and second elongated ellipsoid-shaped depressed region, the first elongated ellipsoid-shaped depressed region being 2-5 times larger in area and deeper than the second elongated ellipsoid-shaped region to underlie respectively the lateral and medial tuberositites of the wearer's calcaneus;

wherein the first elongated ellipsoid-shaped depressed region has an elongate axis running in a rear-to-forward direction of the device and skewed in a direction towards the medial side of the device;

wherein the second elongated ellipsoid-shaped depressed region has an elongate axis running in a rear-to-forward direction of the device and skewed in a direction towards the lateral side of the device;

wherein the second elongated ellipsoid-shaped region is shorter in length than the first elongated ellipsoid-shaped region; and wherein an upper surface of said rear region has a raised portion configured to underlie an area of the wearer's calcaneus forward of the wearer's lateral and medial tuberosities; and an upper surface of the forward region is configured to underlie at least a portion of the shafts of the wearer's metatarsals, the upper surface of said forward region having a generally rounded or ellipsoid shape raised portion which rises to an apex configured to underlie the shafts of the wearer's second and third metatarsals.

2. The device of claim 1, wherein the first ellipsoid-shaped depressed region is larger in volume than the second ellipsoid-shaped depressed region by 40 to 120 percent.

3. The device of claim 1, wherein forward region is raised by 1 to 10 degrees relative to the rear region.

4. The device of claim 1, wherein the first ellipsoid-shaped depressed region is about 0.3 mm deeper than the second ellipsoid-shaped depressed region.

5. The device of claim 1, wherein forward ends of the first and second elongated ellipsoid-shaped depressed regions rise to crescent shaped apices configured to underlie an area forward of the tuberosity of the calcaneus of the wearer.

6. The device of claim 5, wherein the device is 2-8 mm thick at a thickest location.

7. The device of claim 1, wherein the device is 2-8 mm thick at a thickest location.

8. The device of claim 1, wherein the device comprises a heel piece incorporating the rear region and a metatarsal piece incorporating the forward region.

9. The device of claim 1, wherein the left and right shoe pieces are mirror images of one another.

10. A heeled shoe having a device as claimed in claim 1 mounted therein.

11. A heeled shoe as claimed in claim 10, wherein the device is mounted or incorporated into an insole board or sock liner of the shoe.

12. A method for increasing comfort in heeled shoe comprising providing the shoe with a device as claimed in of claim 1.

13. The device of claim 1, wherein the device as installed in a shoe during construction of the shoe.

14. A device for insertion into a heeled shoe comprising:

a heel cup configured to underlie a wearer's calcaneal tuberosity, the heel cup being shaped to underlie the wearer's calcaneal tuberosity, wherein the heel cup includes a foot supporting surface having first and second elongated ellipsoid-shaped depressed regions, the first elongated ellipsoid-shaped depressed region being 2-5 times larger in area and deeper than the second elongated ellipsoid-shaped region, wherein the first elongated ellipsoid-shaped depressed region has an elongate axis running in a rear-to-forward direction of the device and skewed in a direction towards the medial side of the device, the second elongated ellipsoid-shaped depressed region has an elongate axis running in a rear-to-forward direction of the device and skewed in a direction towards the lateral side of the device;

wherein the second elongated ellipsoid-shaped region is shorter in length than the first elongated ellipsoid-shaped region; and wherein an upper surface of said heel cup has a raised portion configured to underlie an area of the wearer's calcaneus forward of the wearer's calcaneus tuberosity.

15. The device of claim 14, wherein the first elongated ellipsoid-shaped depressed region is 40 to 120 percent larger in volume than the second elongated ellipsoid-shaped depressed region.

16. The device of claim 14, wherein the forward end of the device is raised at an angle of from 1 to 10 degrees relative to the rear end.

17. The device of claim 14, wherein the first elongated ellipsoid shaped depressed region is about 0.3 mm deeper than the second elongated ellipsoid-shaped depressed region.

18. The device of claim 14, wherein forward ends of the first and the second elongated ellipsoid-shaped depressed regions rise to crescent shaped apices configured to underlie a portion of a foot of a wearer forward of the tuberosity of the calcaneus of the wearer.

19. The device of claim 1, wherein the first elongated ellipsoid-shaped depressed region is 2.7 times larger in plan than the second elongated ellipsoid-shaped depressed region.

20. The device of claim 14, wherein the first elongated ellipsoid-shaped depressed region is 2.7 times larger in plan than the second elongated ellipsoid-shaped depressed region.

* * * * *